US010815632B2

(12) United States Patent
Del Rey et al.

(10) Patent No.: US 10,815,632 B2
(45) Date of Patent: Oct. 27, 2020

(54) HIGH WATER SPILLWAY FOR BARRAGES AND SIMILAR STRUCTURES, COMPRISING AN INTEGRATED DEVICE FOR AERATING THE DOWNSTREAM BODY OF WATER

(71) Applicant: HYDROPLUS, Rueil-Malmaison (FR)

(72) Inventors: Franck Del Rey, Jouy-en-Josas (FR); André Tavares, Paris (FR); Camille Perard, Rueil-Malmaison (FR)

(73) Assignee: HYDROPLUS, Rueil-Malmaison (FR)

( * ) Notice: Subject to any disclaimer, the term of this patent is extended or adjusted under 35 U.S.C. 154(b) by 4 days.

(21) Appl. No.: 16/481,186

(22) PCT Filed: Jan. 30, 2018

(86) PCT No.: PCT/FR2018/050214
§ 371 (c)(1),
(2) Date: Jul. 26, 2019

(87) PCT Pub. No.: WO2018/142059
PCT Pub. Date: Aug. 9, 2018

(65) Prior Publication Data

US 2019/0390427 A1 Dec. 26, 2019

(30) Foreign Application Priority Data

Jan. 31, 2017 (FR) ..... 17 50815

(51) Int. Cl.
*E02B 7/22* (2006.01)
*E02B 8/06* (2006.01)
*E02B 7/16* (2006.01)

(52) U.S. Cl.
CPC . *E02B 7/16* (2013.01); *E02B 8/06* (2013.01)

(58) Field of Classification Search
CPC ..... E02B 7/22; E02B 8/06; E02B 7/16
(Continued)

(56) References Cited

U.S. PATENT DOCUMENTS 2,118,535 A * 5/1938 Betts ..... E02B 7/205 405/94
5,032,038 A * 7/1991 Lemperiere ..... E02B 8/06 405/108

(Continued)

FOREIGN PATENT DOCUMENTS

EP 0434521 6/1991
EP 0493183 7/1992

OTHER PUBLICATIONS

Search Report & Written Opinion issued in App. No. PCT/FR2018/050214 (2018).

*Primary Examiner* — Edwin J Toledo-Duran
(74) *Attorney, Agent, or Firm* — Barnes & Thomburg LLP; G. Peters Nichols

(57) ABSTRACT

The present invention relates to a high water spillway (5) for barrages and similar structures, comprising a spill threshold (6), the crest of which is located at a first predetermined level (RN) lower than a second predetermined level (RM) corresponding to a maximum level or to the highest water level (PHE) for which the barrage (1) is designed, the difference between said first and second levels (RN and RM) corresponding to a maximum predetermined flow of an exceptional high water, and a fusegate (10) plugging the spillway (5), said gate (10) comprising at least one rigid and solid gate element (11), which is placed on the crest (8) and is held in place thereon by gravity, said gate element being imbalanced when the water reaches a third predetermined level (N) higher than the top of the gate element (11), but at most equal to the second predetermined level (RM). According to the invention, said spillway further comprises an aeration system that comprises at least one duct (20) capable of routing air towards the bottom of the jet discharged by the crest of said gate (11).

8 Claims, 3 Drawing Sheets

(58) Field of Classification Search
USPC ..... 405/80, 87, 90, 94, 107, 108, 110, 111, 405/114
See application file for complete search history.

(56) References Cited

U.S. PATENT DOCUMENTS

| | | | | | |
|---|---|---|---|---|---|
| 5,061,118 | A * | 10/1991 | Lemperiere | E02B 7/16 | 405/108 |
| 5,195,846 | A * | 3/1993 | Lemperiere | E02B 7/16 | 405/108 |
| 5,882,144 | A * | 3/1999 | Lemperiere | E02B 7/16 | 405/80 |
| 6,196,764 | B1 * | 3/2001 | Bayssiguier | E02B 7/16 | 405/102 |
| 8,591,149 | B2 * | 11/2013 | Lacroix | E02B 8/06 | 405/108 |
| 8,876,431 | B1 * | 11/2014 | Becker | E02B 7/22 | 405/111 |
| 2003/0143027 | A1 * | 7/2003 | Obermeyer | E05F 15/53 | 405/115 |
| 2015/0267369 | A1 * | 9/2015 | Kagiannas | E02B 5/08 | 405/108 |

* cited by examiner

HIGH WATER SPILLWAY FOR BARRAGES AND SIMILAR STRUCTURES, COMPRISING AN INTEGRATED DEVICE FOR AERATING THE DOWNSTREAM BODY OF WATER

CROSS REFERENCE TO RELATED APPLICATIONS

This application is a U.S. nationalization under 35 U.S.C. § 371 of International Patent Application No. PCT/FR2018/050214, filed Jan. 30, 2018, which claims priority to French Application No. 1750815, filed Jan. 31, 2017; the entire contents of each are incorporated herein by reference.

The present invention relates to a fusegate for a hydraulic structure such as a river threshold, a spillway on a barrage or a safety embankment comprising a watertight or substantially watertight wall structure installed on said hydraulic structure and maintained thereon by gravity, and capable of clearing so as to allow water to pass through without plugging, the weight and size of said structure being such that it can be flushed by water when it reaches a predefined level.

Fusegates of this type are well known and are routinely installed on the crest of a threshold located across a reservoir to raise the water level of the reservoir upstream of said threshold or to enable an increase in the discharged flow in case of very high water. Installed on the threshold of a barrage, they make it possible to raise the retention level of the barrage and/or improve the safety of said barrage in case of high water. They can also be installed on the spill threshold of a riverside embankment and be designed to protect neighbouring areas from high water, in which case the spillway is installed on the embankment at a selected location so that in the event of high water, water flows into a temporary storage reservoir or onto a selected site that is safe for other areas adjoining the river.

The fusegates can be of the non-spill or spill type, i.e. in the latter case, they can allow a certain amount of water to pass over their crest when the water level upstream of the gate is higher than the retention height (hrn) of the crest and as long as this water level does not exceed a predefined height (hmax). In all cases, the fusegates must be cleared if the water level upstream of the fusegate reaches a predefined level hmax in case of high water, in order to release the volume of water it retains in the reservoir, and thus avoid flooding of upstream neighbouring regions or damage the embankment or the barrage. The fusegates apply in particular to a dyke or an embankment or a barrage. The embankment can be a frontal embankment across a watercourse, or a lateral embankment along a watercourse to protect surrounding lands from high water. In the case of a barrage, it can be any type of barrage creating a water reservoir, or a pass barrage associated with the above-mentioned barrage.

On many hydraulic structures of the type indicated, it is known to create privileged breaking points which, in case of exceptional events, such as exceptional high water which might destroy the structure, give way at predetermined locations in the structure chosen so that the damage caused to the structure itself and/or to persons or property flooded by the destruction of the structure is minimal. These breaking points can be formed using fusegates positioned on the crest of the selected part of the embankment, the fill or the barrage, or other systems to discharge the required flows.

Such a gate comprises at least one rigid and solid gate element which is placed on the crest of the spill threshold and is held in place thereon by gravity, with said gate element having a predetermined retention height hrn and the size and weight of which having selected so that the moment of the forces applied by water to the gate element reaches a certain predefined level hmax, the moment of gravity forces that tend to maintain the gate element in place on the spill threshold and that consequently the gate element is imbalanced and displaced when the water level upstream of the gate reaches the predefined level hmax.

It is clear that for medium high water, as long as the water level does not reach the predefined level hmax of gate imbalance, which can be determined in practice so as to be equal to or lower than the level of the highest water, the water can be discharged through valves and/or other devices sized for most common high waters, without destroying the gate and consequently without the spillway ceasing to be plugged by said gate. On the other hand, in case of exceptionally high water, the water level reaches the predefined level hmax of imbalance of the gate and one or more element(s) of the gate is/are automatically imbalanced and flushed by the water under the sole action of the water forces, thus without any external intervention being necessary, thus restoring the threshold to its full discharge capacity.

Document EP 0 493183 and patent EP 0 434 521 B1 describe such installations.

Moreover, it known that the stability of a fusegate depends on the driving forces that tend to tip or destabilize the element. The destabilizing forces are the water pressure $P_{am}$, on the upstream face of the fusegate and the underpressure U which may be exerted on the base surface of said gate and which is due to the existence of possible leaks at the seals or the filling of the chamber. The resistant forces, which tend to stabilize the gate element, are the dead weight $W_{HF}$ of the gate, the weight of the head of water $W_e$ possibly present above said gate and the water pressure $P_{av}$ on the downstream face of said gate.

When the fusegate is installed in a configuration where the downstream water level can be significant (either permanently or punctually), previous art systems concerning fusegates can be confronted with the problems of aeration of the body of water downstream of said gate.

The air flow downstream of the fusegates depends on its geometry, the geometry of the threshold and that of the channel in the fusegates are placed. In the event of a risk of insufficient aeration of body of water downstream of the gate, which may cause the rising of the downstream level adjacent to the downstream walls of said gate until it is submerged, it is important to ensure the necessary air supply to avoid this phenomenon.

Thus, the main problems that this invention solves can be summarized as follows:

1°/guarantee a water level downstream of the gates, as predicted by studies carried out on digital models or using existing formulas in the literature, all considering the aerated body of water;

2°/maintain and/or increase the operational safety specific to the gates, by increasing the reliability of its operation, particularly during times of exceptional high water;

3°/avoid a degradation of the structures (fusegates, threshold, restitution channel, side walls) which could be generated by the presence of a "negative" pressure under the downstream body of water.

In order to achieve these objectives, the present invention integrates, in the structure of the gate, an aeration system which includes at least one duct capable of routing air towards the bottom of the jet discharged through the crest of said gate. This duct(s) may be made of metal, plastic or any other material suitable for this purpose.

If the gate is made of concrete, these ducts can be openings in the structure, with concrete being the material that delimits the geometry of the aeration system.

The aeration system shall include at least:

an air intake;

a duct integrated in the structure of the gate. The air intake can be:

an aeration vent in the side wall and/or on an intermediate pier of the threshold;

an air inlet integrated in a feedwell as described in patent EP0434521 B1;

an air routing circuit integrated in the threshold to feed the ducts present in the fusegate. In this case, a seal can be placed between the spill threshold (where the gates lie) and the base of the gate, around the aeration pipe. However, such a seal is not absolutely necessary if, in the absence of a seal, there is little water leakage between the gate element and the spill threshold.

The invention can be applied to the spillway of an existing barrage as well as to a barrage under construction.

The fusegate according to the invention can have different shapes. These shapes were presented in patent EP 0 434 521 B1.

The invention relates to a high water spillway for barrages and similar structures comprising a spill threshold, the crest of which is located at a first predetermined level (RN) lower than a second predetermined level (RM) corresponding to a maximum level or to the highest water level (PHE) for which the barrage is designed, the difference between said first and second levels (RN and RM) corresponding to a maximum predetermined flow of an exceptional high water, and a fusegate plugging the spillway, said gate comprises at least one rigid and solid gate element, which is placed on the crest and held in place thereon by gravity, said gate element being imbalanced, when the water reaches a third predetermined level (N) higher than the top of the gate element, but at most equal to the second predetermined level (RM), characterized in that said spillway further comprises an aeration system which comprises at least one duct capable of routing air towards the bottom of the jet discharged by the crest of said gate.

According to one characteristic of the invention, the at least one duct may consist of metal, plastic or any other material adapted to this function.

According to another characteristic of the invention, the at least one duct can include openings in the gate which is made of concrete, concrete then being the material which delimits the geometry of the aeration system.

In addition, the aeration system comprises at least one air intake; a duct integrated in the structure of the gate.

More precisely, said air intake can be an air vent leading to the side wall and/or to an intermediate pier of the spill threshold.

According to another embodiment, said air intake can be an air inlet integrated in a feedwell.

In addition, said air intake can be an air routing circuit integrated in the spill threshold 6 to feed the duct(s) present in the fusegate.

Thus, a seal can be provided between the threshold and the base of the gate, around the aeration pipe.

DESCRIPTIVE FIGURES

FIG. 1 is a general view of a first embodiment of the invention, i.e. a perspective view showing a structure, such as a barrage, and its high water spillway equipped with an aeration system according to the invention;

FIGS. 2*a* and 2*b* are diagrams showing the flows involved and the operating principle of a gate;

DETAILED DESCRIPTION OF EMBODIMENTS OF THE INVENTION

Figure 1:
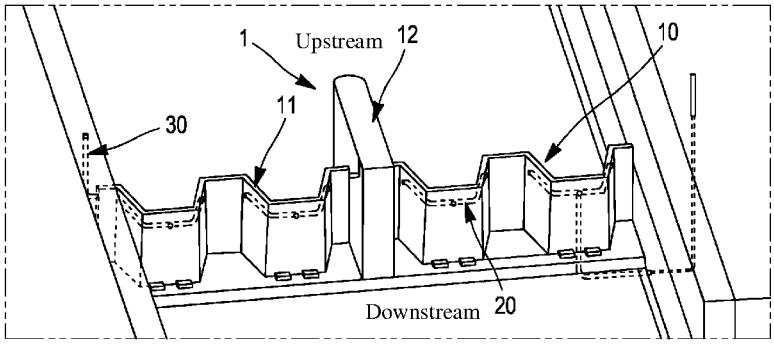

FIG. 1 is a perspective of a high water spillway 5 according to a first embodiment of the invention. The spillway is a construction element generally placed on a "spill threshold" of a barrage. The spill threshold has a crest located at a first level RN lower than a second level RM corresponding to a maximum level or highest water level (PHE) for which the barrage is designed, the difference between said first and second levels (RN and RM) corresponding to a predetermined maximum flow of an exceptional high water.

FIG. 1 shows in greater details a fusegate 10 capable of plugging the spillway. The fusegate can, for example, be made up as described in patent EP 434 521.

Said gate 10 comprises at least one rigid and solid gate element 11, which is placed on the crest 8 and held in place thereon by gravity, said gate element being imbalanced, when the water reaches a third predetermined level (N) higher than the top of the gate element 11, but at most equal to the second predetermined level RM.

As shown in FIG. 1, the fusegate 10 comprises several juxtaposed gate elements 11 arranged through the main flow stream. FIG. 1 illustrates gate elements of identical shapes that have several distinct main planes, here five planes, three of which coincide and are arranged perpendicular to the main flow. The other planes form an angle (e.g. of about 45°) with the three transverse planes.

Interestingly and in response to the issues mentioned above, the spillway according to the invention includes an aeration system comprising at least one duct 20 capable of routing air to the bottom of the jet discharged through the crest of said gate 10.

Figure 2A:
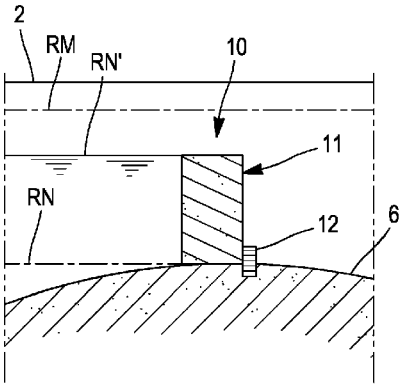
Figure 2B:
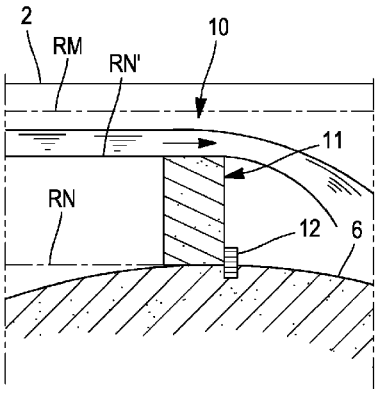

FIG. 2*a* shows the flow, at the RN' level, i.e, retained by the gate element 11, whereas FIG. 2*b* shows the jet discharged above the level of the crest of the gate element 11.

An aeration of the flow is said to be carried out downstream of the gate 10 (or each element of the gate 11).

To do this, at least one duct 20 is provided, preferably fixed or integrated on at least one gate element 11. If the gate element consists of metal walls then the duct(s) is/are fixed to the downstream relative to the direction of the flow motion. If the gate element is made of concrete then a reentrant (an excavation) can be provided in order to form the duct(s) 20.

The or each duct 20 is supplied with air through an inlet or vent 30 which can be placed in several locations.

According to FIG. 1, air vents or inlets 30 are placed laterally to the spillway 5, for example beyond the support wall called the side wall. The vent(s) connect(s) to the duct 20 in the most appropriate way. Here at the threshold of the wall.

Figure 3:
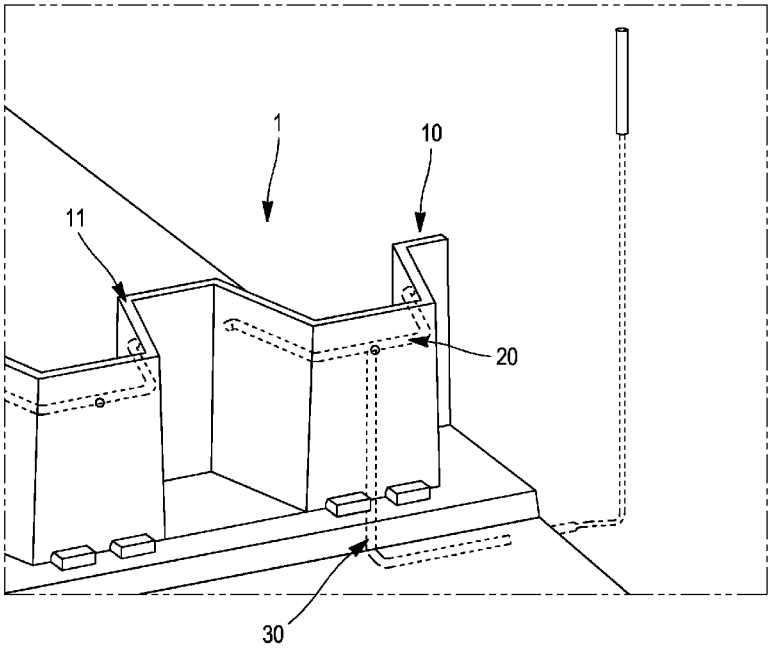
FIG. 3 is a diagram in perspective of a second embodiment of the invention.

According to FIG. 3, the air inlets 30 are located in the lateral support wall.

Figure 4:
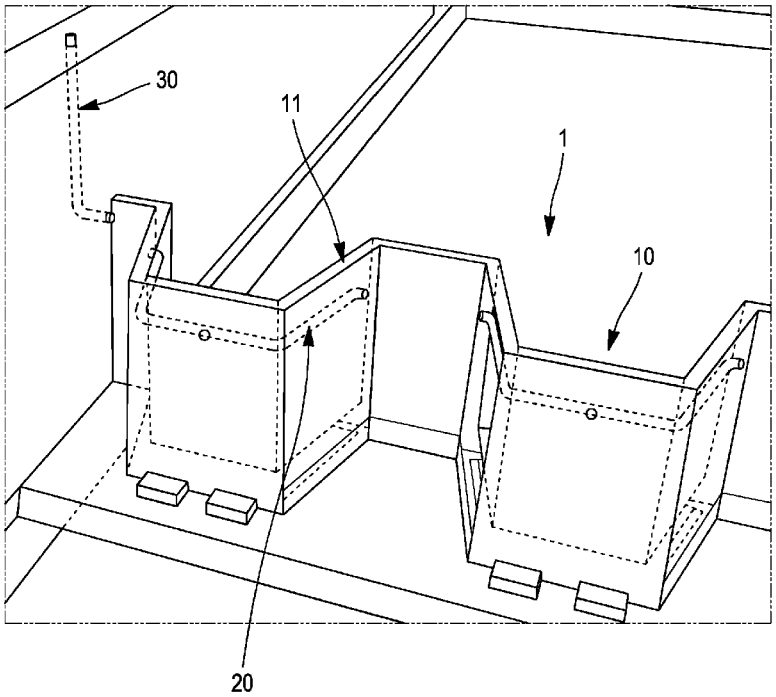
FIG. 4 is a diagram in perspective of a third embodiment of the invention.

In the illustrative example in FIG. 4, the air inlets are placed in a support pier 40 located between two gate elements 11.

The invention claimed is:

1. A high water spillway for barrages and similar structures comprising:

a spill threshold with a crest located at a first predetermined level (RN) lower than a second predetermined level (RM), the second predetermined level corresponding to a maximum level or to a highest water level (PHE) for which the barrage and similar structures are designed, wherein a difference between the first predetermined level and the second predetermined level corresponds to a predetermined maximum flow of an exceptional high water;

a fusegate plugging the spillway, the fusegate comprises at least one solid gate placed on the crest and held in place by gravity, the gate being imbalanced when the water reaches a third predetermined level (N) higher than the top of the gate but at most equal to the second predetermined level (RM);

an aeration system that comprises at least one duct that routes air downstream of the gate towards a bottom of a jet discharged by a crest of the gate.

2. The high water spillway according to claim 1, wherein the at least one duct comprises pipes.

3. The high water spillway according to claim 1, wherein the gate is made of concrete, which delimits the geometry of the aeration system and wherein the at least one duct includes openings in the gate.

4. The high water spillway according to claim 1, wherein the aeration system further comprises an air intake such that the air intake and the at least one duct are integrated in the fusegate.

5. The high water spillway according to claim 4, wherein the air intake is an air vent leading to a side wall and/or to an intermediate pier of the spill threshold.

6. The high water spillway according to claim 4, wherein the air intake is an air inlet integrated in a feedwell.

7. The high water spillway according to claim 4, wherein the air intake is an air routing circuit integrated in the spill threshold to feed the at least one duct.

8. The high water spillway according to claim 4, further comprising a seal provided between the spill threshold and a base of the fusegate around the aeration system.

* * * * *